US006895936B2

(12) United States Patent
Kuroda

(10) Patent No.: US 6,895,936 B2
(45) Date of Patent: May 24, 2005

(54) COMMON RAIL TYPE FUEL INJECTION SYSTEM

(75) Inventor: Akihiro Kuroda, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/861,478

(22) Filed: Jun. 7, 2004

(65) Prior Publication Data

US 2004/0261769 A1 Dec. 30, 2004

(30) Foreign Application Priority Data

Jun. 27, 2003 (JP) ..... 2003-185751
Apr. 23, 2004 (JP) ..... 2004-127997

(51) Int. Cl.[7] ..... F02M 59/00

(52) U.S. Cl. ..... 123/446; 123/458; 123/467; 123/514; 123/516

(58) Field of Search ..... 123/446, 447, 123/456, 457, 458, 467, 495, 510, 514, 516

(56) References Cited

U.S. PATENT DOCUMENTS 5,373,829 A * 12/1994 Schuers et al. ..... 123/510
5,626,121 A * 5/1997 Kushida et al. ..... 123/514
6,024,064 A * 2/2000 Kato et al. ..... 123/179.17
6,058,912 A 5/2000 Rembold et al.
6,729,309 B2 * 5/2004 Schueler ..... 123/514
6,792,915 B2 * 9/2004 Rembold et al. ..... 123/446
2002/0134360 A1 9/2002 Hankins et al.

FOREIGN PATENT DOCUMENTS

DE 199 27 804 A1 12/2000
EP 1262659 A2 12/2002
JP 2001-295685 10/2001

* cited by examiner

*Primary Examiner*—Weilun Lo
(74) *Attorney, Agent, or Firm*—Nixon & Vanderhye P.C.

(57) ABSTRACT

In a common rail type fuel injection system, fuel in a fuel tank is sucked by a feed pump and fed to a pressurizing pump. Fuel pressurized in the pressurizing pump is supplied to a common rail. The pressurized fuel accumulated in the common rail is injected into a cylinder of an internal combustion engine from an injector. All of these operations are electronically controlled by an electronic control unit. To gradually suck air in the fuel tank together with fuel and to avoid air accumulation in a fuel filter, a relief valve is connected to the common rail. The relief valve is opened when the engine is idling thereby to increase an amount of fuel sucked by the feed pump and to gradually suck the air together with the fuel. The relief valve is opened only in interval periods in which fuel is not injected from the injector.

4 Claims, 3 Drawing Sheets

COMMON RAIL TYPE FUEL INJECTION SYSTEM

CROSS-REFERENCE TO RELATED APPLICATIONS

This application is based upon and claims benefit of priority of Japanese Patent Applications No. 2003-185751 filed on Jun. 27, 2003 and No. 2004-127997 filled on Apr. 23, 2004, the contents of which are incorporated herein by reference.

BACKGROUND OF THE INVENTION

1. Field of the Invention

The present invention relates to a common rail type fuel injection system for supplying pressurized fuel into an internal combustion engine such as a diesel engine.

2. Description of Related Art

An example of this type of a fuel injection system is disclosed in JP-A-2001-295685. In this system, fuel in a fuel tank is sucked by a feed pump and fed to a fuel supply pump that pressurizes the fuel. The pressurized fuel is supplied to a common rail that accumulates therein the pressurized fuel. The pressurized fuel is injected from an injector into a cylinder of a diesel engine. Injection timing and amount of fuel injected into the cylinder are controlled by an electronic control unit.

There has been the following problem in such a conventional system. An amount of fuel sucked by the feed pump is small when the engine is under an idling state and at a low load. Accordingly, a flow speed of the fuel is low, and air in the fuel tank sucked together with the fuel is gradually accumulated in a fuel filter connected between the fuel tank and the feed pump. After a certain amount of the air is retained in the filter, the retained air is sucked at a time into the feed pump. When a large amount of air is sucked at a time into the feed pump, fuel to be supplied to the common rail cannot be sucked by the feed pump. Therefore, fuel pressure in the common rail drops, and fuel supply to the engine is temporarily discontinued. If this happens, the engine will come to a stall.

SUMMARY OF THE INVENTION

The present invention has been made in view of the above-mentioned problem, and an object of the present invention is to provide an improved common rail type fuel injection system, in which accumulation of a large amount of air in a fuel filter is prevented.

The fuel injection system includes a feed pump for sucking fuel from a fuel tank, a pressurizing pump for pressurizing the fuel fed from the feed pump, a common rail for accumulating the pressurized fuel at a constant pressure, and an injector for injecting the pressurized fuel into a cylinder of an internal combustion engine. Operation of the system is electronically controlled by an electronic control unit.

To avoid the problem involved in the conventional system that air is accumulated in a fuel filter when the engine speed or the engine load is low (such as in an idling state), a relief valve is attached to the common rail. The relief valve is opened, when the engine is idling, for example, to decrease the pressure in the common rail and to increase an amount of fuel sucked by the feed pump. The amount of fuel sucked by the feed pump is maintained above a required level that enables the feed pump to gradually suck air from the fuel tank together with fuel. Thus, it is avoided to suck a large amount of accumulated air at a time into the feed pump. As a result, the feed pump can stably supply fuel to the common rail. The relief valve is opened only in interval periods in which fuel is not injected from the injector to avoid an injection pressure drop by opening the relief valve.

Other objects and features of the present invention will become more readily apparent from a better understanding of the preferred embodiment described below with reference to the following drawings.

DETAILED DESCRIPTION OF THE PREFERRED EMBODIMENT

Figure 1:
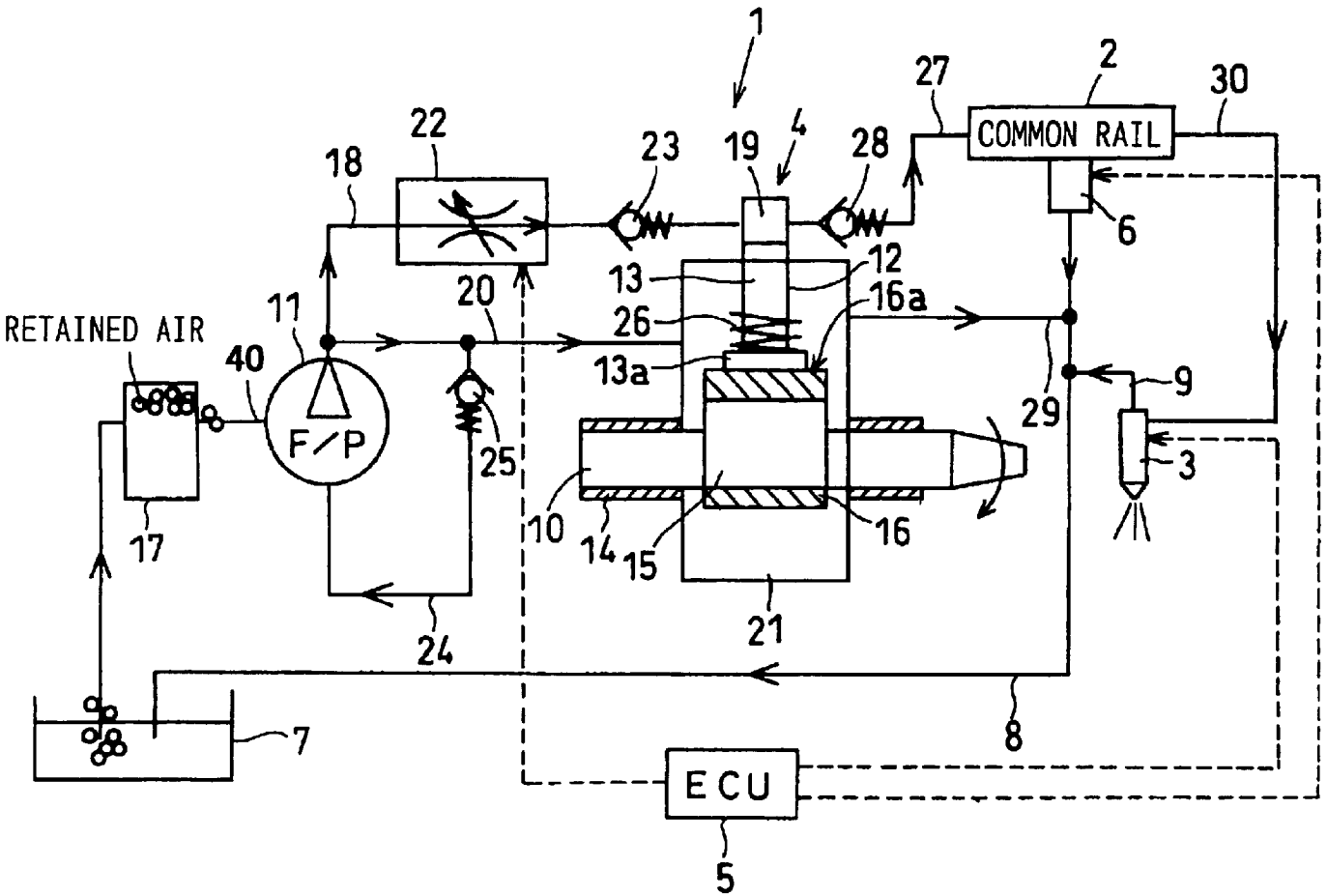
FIG. 1 is a block diagram showing an entire structure of a common rail type fuel injection system according to the present invention.

A preferred embodiment of the present invention will be described with reference to accompanying drawings. First, referring to FIG. 1, an entire structure of a common rail type injection system 1 of the present invention will be described. The fuel injection system 1 is applied to a diesel engine mounted on an automobile vehicle, for example. The system includes a common rail 2 in which pressurized fuel is stored; an injector 3 that injects the pressurized fuel supplied from the common rail 2 into a cylinder of an engine; a fuel supply pump 4 for supplying the pressurized fuel to the common rail 2; an electronic control unit (ECU) 5 for electronically control operation of the system; and other associated components.

The common rail 2 stores fuel pressurized at a target pressure (a target rail pressure) calculated based on a rotational speed Ne of the engine and an engine load Le (corresponding to an opening degree of an accelerator). The common rail 2 is connected through a relief valve 6 to a return passage 8 that is led to a fuel tank 7. When the relief valve 6 is opened, the pressurized fuel in the common rail 2 returns to the fuel tank 7. The relief valve 6 is an electromagnetic valve controlled by the ECU 5. An amount of current supplied to a solenoid of the relief valve 6 is duty-controlled by the ECU 5, so that a degree of opening of the relief valve 6 is controlled according to the amount of current. The relief valve 6 is closed by a biasing force of a spring when no current is supplied.

The injector 3 includes an electromagnetic valve controlled by the ECU 5. An amount of fuel injected from the injector 3 and injection timing are controlled by controlling the electromagnetic valve. Part of the fuel supplied to the injector 3 is not injected from the injector 3 and returns to the fuel tank 7 through a leak passage 9 connected to the return passage 8.

The fuel supply pump 4 is composed of a camshaft 10 driven by the engine, a feed pump 11 that sucks fuel from the fuel tank 7, a plunger 13 disposed in a cylinder 12 and reciprocally driven by the camshaft 10, and other associated components. The camshaft 10 is rotatably supported by bearings 14 in a pump housing. A cam 15 is formed integrally with the camshaft 10, and a cam ring 16 is coupled to the cam 15 via a metal bushing (not shown) so that the cam ring 16 rotates relative to the cam 15. When the camshaft 10 rotates, the plunger 13 contacting the outer surface 16*a* of the cam ring 16 is reciprocally driven in the cylinder 12.

The feed pump 11 may be constituted by a known trochoid pump, for example. The feed pump 11 is driven by the camshaft 10 and sucks the fuel in the fuel tank 7 through a filter 17 and a sucking passage 40. The fuel sucked by the feed pump 11 is delivered to two directions. A part of the fuel is fed to a pressurizing chamber 19 in the cylinder 12 through a feeding passage 18, an adjusting valve 22 and a one-way valve 23. The other part of the fuel is supplied to a cam chamber 21 through a lubrication passage 20. The adjusting valve 22 is controlled by the ECU 5 to adjust an amount of fuel fed to the pressurizing chamber 19. The one-way valve 23 only permits fuel flow from the feed pump 11 to the pressurizing chamber 19. A circulation passage 24 having a one-way valve 25 is connected to the lubrication passage 20. When a pressure in the feed pump 11 exceeds a predetermined level, the one-way valve 25 opens and the fuel is circulated to the feed pump 11.

The plunger 13 is slidably disposed in the cylinder 12 formed in the pump housing. A plunger head 13*a* connected to one end of the plunger 13 slidably contacts the outer surface 16*a* of the cam ring 16. The plunger 13 is reciprocally driven in the cylinder 12 according to rotation of the camshaft 10. The pressurizing chamber 19 is formed in the cylinder 12 at the other end of the plunger 13. The capacity of the pressurizing chamber 19 changes according to the reciprocal movement of the plunger 13. When the capacity of the pressurizing chamber 19 increases, the fuel fed from the feed pump 11 is introduced into the pressurizing chamber 19. When the capacity of the pressurizing chamber 19 decreases, the fuel therein is pressurized and supplied to the common rail 2 through a supply passage 27. A one-way valve 28 that permits fuel to flow only from the fuel supply pump 4 to the common rail 2 is provided in the supply passage 27.

The cam chamber 21 containing therein the camshaft 10, to which the cam ring 16 is coupled, is formed in the pump housing. A part of the fuel delivered from the feed pump 11 is supplied to the cam chamber 21 so that the cam 15 and the cam ring 16 coupled to the cam 15 are lubricated by the fuel. Fuel overflowed from the cam chamber 21 returns to the fuel tank 7 through a passage 29 and the return passage 8.

The ECU 5 controls operation of the adjusting valve 22, the injector 3 and the relief valve 6 according to a pre-installed program and based on a rotational speed Ne of the engine, an engine load Le (an opening degree of an accelerator) and a pressure Pc in the common rail 2. Since the electronic control of the adjusting valve 22 and the injector 3 is well known, such controls will not be described here. The control of the relief valve 6 will be described below in detail.

An amount of fuel sucked by the feed pump 11 is small when rotational speed Ne of the engine is low or the engine load Le is low. Accordingly, flow speed of the fuel is not high enough to gradually suck air contained in the fuel tank 7 into the feed pump 11. Therefore, a large amount of air may be accumulated in the fuel filter 17, and the accumulated air may be sucked suddenly at once into the feed pump 11. If this occurs, the feed pump 11 will become unable to feed the fuel to the common rail 2. The pressure in the common rail 2 will drop and fuel will not be injected from the injector 3 in a sufficient amount. This may lead the engine to a stall.

If the flow speed of the fuel (an amount of fuel sucked by the feed pump 11) is maintained at a certain level, air in the fuel tank 7 will be gradually sucked into the feed pump 11, and a large amount of air will not be accumulated in the filter 17. Therefore, the phenomenon that a large amount of air is suddenly sucked into the feed pump 11 will not occur. In other words, if the flow speed of the fuel (amount of fuel) is kept above a certain level that enables the feed pump 11 to gradually suck the air together with fuel, the problem described above will not occur. An amount of sucked fuel realizing the enabling level of the fuel flow speed is referred to as "a required sucking amount".

Figure 2:
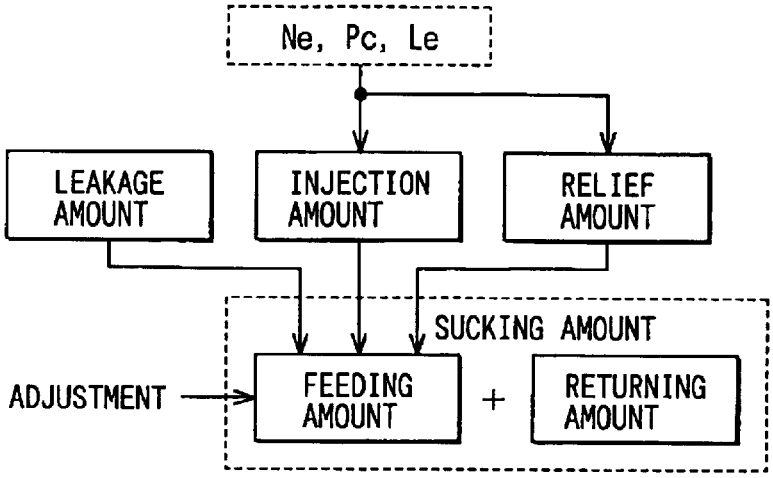
FIG. 2 is a chart showing relation of fuel amounts in various places in a system.

As shown in FIG. 2, the amount of fuel sucked by the feed pump 11 (sucking amount) is a sum of an amount of fuel delivered from the fuel pump 11 (feeding amount) and an amount of fuel returned to the fuel tank 7 (returning amount) through the return passage 8. The sucking amount mainly depends on the feeding amount. When the relief valve 6 is closed, the feeding amount is a sum of an amount of fuel injected from the injector 3 (injection amount) and an amount of fuel leaking or overflowing from the injector 3 (leakage amount). On the other hand, when the relief valve 6 is opened, an amount of fuel flowing out from the common rail 2 (relief amount) is added to those amounts, i.e., the feeding amount is a sum of the injection amount, the leakage amount and the relief amount. Therefore, the feeding amount can be increased by opening the relief valve 6, thereby increasing the sucking amount.

Figure 3:
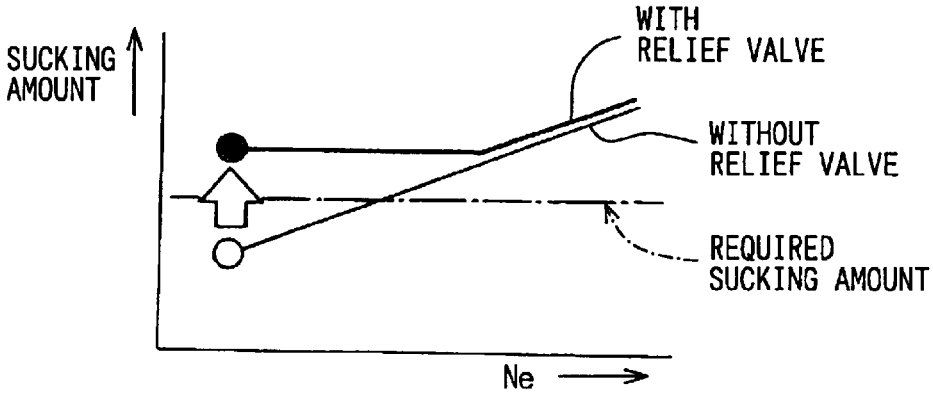
FIG. 3 is a graph showing a relation between rotational speed of an engine and an amount of fuel sucked by a feed pump.
Figure 4:
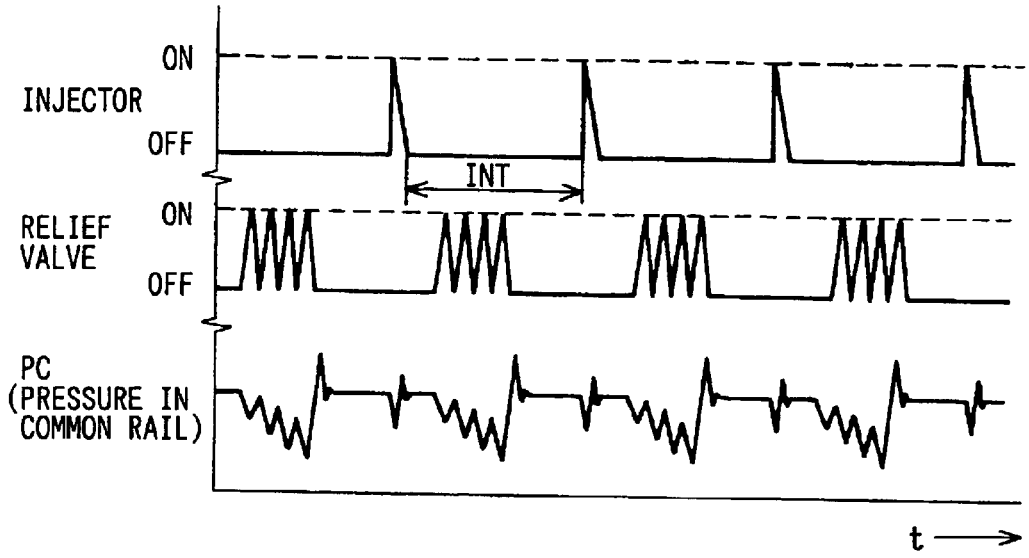
FIG. 4 is a timing chart showing when a relief valve is opened to relieve the high pressure in a common rail.

The injection amount and the relief amount are calculated by the ECU 5 based on a rotational speed Ne of the engine, a fuel pressure Pc in the common rail 2 and an engine load Le (an opening degree of the accelerator). As shown in FIG. 3, to realize the required sucking amount when the rotational speed Ne of the engine or the engine load Le is lower than a predetermined level, the ECU 5 opens the relief valve 6 until the sucking mount reaches the required amount. However, as shown in FIG. 4, the relief valve 6 is intermittently opened only in interval periods INT in which fuel is not injected from the injector 3. In this manner, the relief valve 6 can be opened without adversely affecting the injection pressure.

The injection system described above operates in the following manner. Fuel in the fuel tank 7 is sucked by the feed pump 11 and fed to the pressuring chamber 19. When the plunger 13 enlarges the pressurizing chamber 19, the fuel is fed to the pressuring chamber 19. When the plunger 13 moves upwards, the fuel in the pressurizing chamber 19 is pressurized. The pressurized fuel is supplied to the common rail 2 through the one-way valve 28, and thus the pressurized fuel at a predetermined pressure is accumulated in the common rail 2. The pressurized fuel in the common rail 2 is supplied to the injector 3 that injects fuel into a cylinder of the engine under control of the ECU 5.

When the engine is idling, the relief valve 6 is opened under control of the ECU 5. The pressurized fuel in the common rail 2 flows out and returns to the fuel tank 7 through the return passage 8. This increases the feeding amount of the feed pump 11, resulting in increase in the sucking amount. The relief valve 6 is opened until the sucking amount reaches the required sucking amount that enables the feed pump 11 to gradually suck the air together with the fuel. In this manner, it is avoided that air is accumulated or retained in the filter 17 and that a large amount of the retained air is sucked at a time into the feed pump 11. Thus, the feed pump 11 can stably supply fuel to the common rail 2 to maintain the fuel pressure in the common rail 2 at a constant level.

The relief valve 6 is opened only in the interval periods INT (refer to FIG. 4) in which no fuel is injected from the injector 3. Therefore, even if the fuel pressure in the common rail 2 is temporarily decreased by opening the relief valve 6, the pressure is recovered by the next injection. As a result, the injection pressure and an amount of fuel injected are not adversely affected by opening the relief valve 6.

In the embodiment described above, the relief valve 6 is opened when the engine is idling. However, it is also possible to open the relief valve 6 when the engine speed Ne is low even if the engine load Le is relatively high and when the engine load Le is low even if the engine speed Ne is relatively high. In other words, the relief valve 6 may be controlled to open where there is a possibility that air will be accumulated in the filter 17 and a large amount of the accumulated air will be sucked at one time. It is also possible to control the relief valve 6, not depending on the engine speed Ne or the engine load Le, so that the sucking amount of the feed pump 11 is always maintained above the required sucking amount. In this case, the relief valve 11 may be controlled by feeding back the sucking amount or the flow speed of the sucked fuel.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A fuel injection system for supplying pressurized fuel to an internal combustion engine, the fuel injection system comprising:

a fuel supply pump including a feed pump for sucking fuel from a fuel tank, the fuel supply pump pressurizing the fuel;

a common rail for storing the pressurized fuel sent from the fuel supply pump;

a fuel injector for injecting the pressurized fuel stored in the common rail into a cylinder of the internal combustion engine;

a relief passage for returning the pressurized fuel in the common rail to the fuel tank; and a relief valve for selectively opening and closing the relief passage, wherein:

the relief valve is opened in interval periods in which the pressurized fuel is not injected from the fuel injector and when a rotational speed of the internal combustion engine is lower than a predetermined speed or an engine load is lower than a predetermined load.

2. The fuel injection system as in claim 1, wherein:

the relief valve is opened when the internal combustion engine is under an idling state.

3. A fuel injection system for supplying pressurized fuel to an internal combustion engine, the fuel injection system comprising:

a fuel supply pump including a feed pump for sucking fuel from a fuel tank, the fuel supply pump pressurizing the fuel;

a common rail for storing the pressurized fuel sent from the fuel supply pump;

a fuel injector for injecting the pressurized fuel stored in the common rail into a cylinder of the internal combustion engine;

a relief passage for returning the pressurized fuel in the common rail to the fuel tank; and a relief valve for selectively opening and closing the relief passage, wherein:

the relief valve is opened or closed in a controlled manner so that an amount of fuel sucked by the feed pump is always larger than a predetermined amount so as to gradually suck air in the fuel tank together with fuel and to avoid air accumulation in a fuel filter.

4. The fuel injection system as in claim 3, wherein:

the relief valve is opened in interval periods in which the pressurized fuel is not injected from the fuel injector.

* * * * *